United States Patent [19]

Merker et al.

[11] 4,053,400

[45] Oct. 11, 1977

[54] PURIFICATION OF NICKEL AND COBALT ELECTROPLATING SOLUTIONS

[75] Inventors: Reuven Merker, Englewood Cliffs; Salvatore Lucca, Paramus, both of N.J.

[73] Assignee: The Metalux Corporation, Paterson, N.J.

[21] Appl. No.: 398,992

[22] Filed: Sept. 20, 1973

[51] Int. Cl.[2] ..... C25D 3/12; B01D 9/00

[52] U.S. Cl. ..... 204/49; 204/48; 210/54

[58] Field of Search ..... 204/49, 48, 112; 210/54, 59, 60

[56] References Cited

U.S. PATENT DOCUMENTS

| | | | |
|---|---|---|---|
| 2,406,960 | 9/1946 | Neal et al. | 260/239 |
| 2,773,022 | 12/1956 | Turner | 204/52 Y |
| 3,518,171 | 6/1970 | Merker et al. | 204/49 |

OTHER PUBLICATIONS

Metal Finishing, p. 43, Nov. 1969.

*Primary Examiner*—G. L. Kaplan
*Attorney, Agent, or Firm*—G. D. Thorn et al., "The Dithiocarbamates and Related Compounds", pp. 157-164, (1962).

[57] ABSTRACT

Zinc, copper and/or iron impurities ordinarily associated with nickel or cobalt electroplating baths can be removed from solution by introducing an amount of a predetermined and selected alkylthiuram sulfide compound into the electroplating bath sufficient to convert the zinc, copper and/or iron impurities into relatively insoluble metal salts. The insoluble salts may then be removed from the bath by passing the treated solution through a standard filtering system.

2 Claims, No Drawings

PURIFICATION OF NICKEL AND COBALT ELECTROPLATING SOLUTIONS

BACKGROUND OF THE INVENTION

1. Field of the Invention

The present invention relates to a method for the removal of metallic impurities from aqueous acidic nickel or cobalt solutions. More particularly, the invention relates to a method of removing zinc, copper and/or iron impurities from acid nickel electroplating solutions.

2. Prior Art

Plating processes differ in sensitivity to the presence of metallic impurities within the electroplating bath. Thus, for example, while stannate tin is extremely tolerant of most impurities, bright nickel and most cobalt plating solutions are sensitive to the presence of impurities. Various means have been devised for purifying aqueous metal solutions by chemical treatment or with the use of mechanical means. One conventional technique, for example, for purifying electroplating solutions is the process known as "dummying". This consists of plating for a period of time and usually at low current densities upon cathodes which are not intended for use, such as pieces of scrap sheet metal. This low current density electrolysis plates out metallic impurities and/or decomposes some organic contaminants.

Another method for the removal of contaminants from metal solutions consists of passing the solution, intermittently or continuously, through a filter or a series of such devices. This technique, while satisfactory for insoluble impurities, is not adequate for the removal of dissolved impurities. Problems of this type have been overcome with the use of additive materials which react with or complex with the soluble impurities. An operation of this general type is disclosed by Michael in U.S. Pat. No. 3,257,294. While the technique is effective for the removal of soluble metallic impurities, a difficult problem exists for each individual application in locating a composition that can be added to the metallic solution without further increasing impurity problems and which will preferentially react or complex with the soluble metallic impurities to form relatively insoluble compositions that can be subsequently removed using filtration techniques.

These two aforementioned methods have been already overcome and improved upon by the method described in U.S. Pat. No. 3,518,171 issued June 30, 1970 and assigned to the assignee of the present invention. The substances to be added to the bath and disclosed in this last mentioned U.S. patent are, however, selected di-alkyl-dithiocarbamate salts and their utilization is described as applicable to nickel electroplating baths.

It is, therefore, an object of this invention to provide a new class of compounds for the removal of soluble zinc, copper and/or iron impurities from aqueous nickel or cobalt solutions, utilizing the technique disclosed and claimed in said U.S. Pat. No. 3,518,171.

SUMMARY OF THE INVENTION

In accordance with the present invention, it has been found that the soluble zinc, copper and/or iron impurities contained in nickel or cobalt electroplating solutions, in particular aqueous acidic nickel or cobalt solutions, may be removed from solutions by mixing the solutions with a predetermined amount of an organic compound corresponding to the general empirical formula a—S—X, wherein "*a*" represents the radical

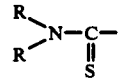

in which R is a methyl, ethyl or butyl group; S is sulphur; and X is one of the following: —H, —Na, —K, —Li, —"*a*" as defined hereabove, —SH, —S—S—H, —S—S—S—H, —S—Na, —S—S—Na, —S—S—S—Na, —S—K, —S—S—K, —S—S—S—K, —S—Li, —S—S—Li, —S—S—S—Li, —S—"*a*", —S—S—"*a*", —S—S—S—"*a*", —Ni—S—"*a*", —Co—S—"*a*".

These compounds react with or complex with soluble metallic impurities to form materials at best very sparingly soluble in the aqueous acidic nickel or cobalt solutions. The insoluble materials are thereafter removed using the filtration technique disclosed in the afore-mentioned U.S. Pat. No. 3,518,171. In conjunction with such filtration technique, involving the continuous or, if so desired, intermittent circulation of a nickel or cobalt solution from a tank through a filtering chamber or zone, in which a filtering membrane and materials such as activated carbon and filter aids are utilized, or in conjunction with other more conventional and older filtering techniques, the present inventions contemplates the use of anyone of the compounds represented hereinabove by the empirical formula a—S—X. Typical compounds represented by a—S—X are, for example, diethyl-dithio carbamate, sodium dimethyl-dithio carbamate, potassium dibutyl-dithio carbamate, tetra-methyl-thiuram monosulfide, tetra-methyl-thiuram disulfide cobalt diethyl-dithio carbamate, nickel diethyl-dithio carbamate, etc.

As mentioned before, some of these compounds are well known rubber accelerators, such as, for example, the tetra-methyl-thiuram-disulfide

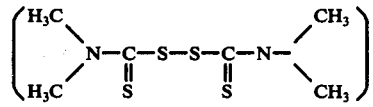

and the tetra-methyl-thiuram-monosulfide

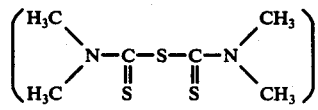

As noted earlier, the removal of the soluble metallic impurities, in particular zinc, copper and/or iron impurities that are normally associated with nickel or cobalt solutions, occurs by the formation of insoluble compounds or complexes with the particular a—S—X compound utilized. Thereafter, these insoluble materials are removed from the system by means of filtration techniques, particularly the filtration technique of U.S. Pat. No. 3,518,171 which is incorporated of reference herewith.

The amount of additive a—S—X compound employed in any given system depends upon the amount of impurities sought to be removed and upon the identity of such impurities. Generally, about one to two grammole of the a—S—X compound will remove one grammole of divalent metal impurities. The amount of additive needed for any given application will trend upwardly for metal impurities having valences greater than two and downwardly for metal impurities having valences less than two. In most instances, complete removal of the metallic impurities is not necessary, as it is normally sought to reduce the impurity level or concentrations to a point where the impurities do not seriously interfere with the end use of the aqueous nickel or cobalt solution.

ILLUSTRATIVE DESCRIPTION OF THE INVENTION

The following examples are given to illustrate the invention. These examples are merely representative and typical demonstrations of the invention and should not be construed as being limitative thereof. They have been carried out using nickel bath solutions, although cobalt bath solutions are equally operative.

Six bath solutions for plating zinc die castings were prepared. Each solution consisted of 420 gallons of bright nickel solution comprising 40 ounces per gallon of nickel sulfate, 12 ounces per gallon of nickel chloride and 8 ounces per gallon of boric acid. To these conventional nickel solutions was added about 5% by volume of organic additives for brightening purposes. In each case, the temperature of the bath was maintained in the neighborhood of 130° F and the pH of the solution was maintained at about 4.2. The bath solutions were continuously recirculated at a rate of about 400 gallons per hour by passing the solutions through a filtering zone comprising a conventional industrial filter membrane and, upstream thereof, a conventional amount of inert filtering materials (activated carbon and filter aids). The purpose of these materials was to facilitate the operation of the filter membrane. About 300 grams of additive material containing the a—S—X compounds were separately prepared and added, as shown in the following table I, to the filtration zone, upstream of the filter membrane. Three samples were withdrawn from the electroplating bath during the course of an eight hour run. The first samples, denoted A, were taken before the treatment of the solution; the second samples, denoted B, were taken after one hour of filtration with the a—S—X compound in the filtration chamber; and, finally, samples C were taken after about eight hours of electrodeposition filtration. Analyses effected by conventional atomic absorption techniques, showed the results given in table I, from the tabulated results of which it can be seen that after about eight hours of operation, the metallic impurities, previously soluble, had been removed to a considerable extent.

Table I

| Run | Compound employed | grams of compound utilized | impurities in Solution (in p.p.m.) Sample A Cu | Sample A Zn | Sample A Fe | Sample B Cu | Sample B Zn | Sample B Fe | Sample C Cu | Sample C Zn | Sample C Fe |
|---|---|---|---|---|---|---|---|---|---|---|---|
| 1 | $(CH_3)_2-N-C(=S)-S-H$ | 300 | 8 | 20 | 8 | 4 | 12 | 4 | 1 | 6 | 2 |
| 2 | $(C_2H_5)_2-N-C(=S)-S-Na$ | 300 | 10 | 25 | 4 | 4 | 11 | 13 | 1 | 3 | 2 |
| 3 | $(CH_3)_2-N-C(=S)-S-C(=S)-N-(CH_3)_2$ | 500 | 10 | 30 | 10 | 3 | 11 | 3 | 0 | 3 | 3 |
| 4 | $(CH_3)_2-N-C(=S)-S-S-C(=S)-N-(CH_3)_2$ | 400 | 15 | 20 | 1 | 4 | 15 | 0 | 1 | 10 | 0 |
| 5 | $(CH_3)_2-N-C(=S)-Ni-S-C(=S)-N-(CH_2)_2$ | 400 | 7 | 27 | 4 | 3 | 12 | 2 | 1 | 11 | 1 |
| 6 | $(C_2H_5)_2-N-C(=S)-Co-S-C(=S)-N-(C_2H_5)_2$ | 400 | 25 | 35 | 1 | 12 | 18 | 0 | 2 | 15 | 0 |

The additive, if so desired, may be added to the bath at successive intervals, rather than in a single addition at the beginning of the filtration operation.

From the examples given hereabove, it is evident that the impurities in the solution were reduced to such a low level that they can no longer be considered relevant. Of particular importance is the fact that a cobalt-containing additive compound such as that of run No. 6 may be utilized with extremely satisfactory results in a nickel bath solution.

What is claimed is:

1. In the process wherein a metal selected from nickel and cobalt is electrodeposited from an aqueous acidic solution containing ions thereof, wherein said solution is at least periodically fed through a filtration chamber to remove impurities therefrom, and wherein, during use, metallic impurities selected from the group consisting of zinc, copper and iron build up in solution; the improvement in said process wherein there is added to the solution in amounts sufficient to precipitate the metallic impurities, whereby the metallic impurities are filtered out of said solution, an organic compound having the general formula a—S—X, wherein *a* represents the radical

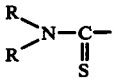

in which R is a group selected from methyl, ethyl and butyl, S is sulphur, and X is one of the following: —H, —Na, —K, —Li, —*a* as defined hereabove, —S—H, —S—S—H, —S—S—S—H, —S—Na, —S—S—Na, —S—S—S—Na, —S—K, —S—S—K, —S—S—S—K, —S—Li, —S—S—Li, —S—S—S—Li, —S—a, —S—S—a, —S—S—S—a, and —Co—S—a.

2. The improvement in the process according to claim 1, wherein the metal electrodeposited from the aqueous acidic solution is nickel and the additive to precipitate the metallic impurities is selected from the group consisting of dimethyl-dithio carbamate, diethyl-dithio carbamate, sodium dimethyl-dithio carbamate, sodium diethyl-dithio carbamate, tetra methyl thiuram monosulfide, tetra methyl thiuram disulfide, potassium dibutyl-dithio carbamate, and cobalt diethyl-dithio carbamate.

* * * * *